US007950975B1

(12) United States Patent
Chapman, Jr.

(10) Patent No.: US 7,950,975 B1
(45) Date of Patent: May 31, 2011

(54) SIMULATION PLAY KIT

(76) Inventor: Weakly Chapman, Jr., Jackson, MS (US)

( * ) Notice: Subject to any disclaimer, the term of this patent is extended or adjusted under 35 U.S.C. 154(b) by 237 days.

(21) Appl. No.: 12/474,121

(22) Filed: May 28, 2009

(51) Int. Cl.
*A63H 33/00* (2006.01)

(52) U.S. Cl. ..... 446/26; 472/133; 482/51; 16/430

(58) Field of Classification Search ..... 472/133; 2/162, 16, 169; 482/51; 446/327, 26; 16/430; D21/658
See application file for complete search history.

(56) References Cited

U.S. PATENT DOCUMENTS

| | | | | | |
|---|---|---|---|---|---|
| 3,626,609 | A | * | 12/1971 | Cramer | 36/7.5 |
| 4,493,334 | A | | 1/1985 | Semanchick et al. | |
| 4,688,789 | A | * | 8/1987 | Alter | 482/51 |
| 5,571,065 | A | * | 11/1996 | Buitoni | 482/74 |
| D378,108 | S | * | 2/1997 | Shippy | D21/658 |
| 5,829,463 | A | | 11/1998 | Galan | |
| 5,890,259 | A | * | 4/1999 | Sarac | 16/422 |
| 5,954,074 | A | | 9/1999 | Mattson | |
| 6,475,051 | B1 | | 11/2002 | Griffin et al. | |
| 6,581,211 | B1 | * | 6/2003 | Golden | 2/158 |
| 7,347,215 | B1 | | 3/2008 | Birnbaum | |
| 7,530,876 | B1 | * | 5/2009 | Wimberly | 446/327 |
| 2005/0159072 | A1 | * | 7/2005 | Brown et al. | 446/26 |
| 2006/0174449 | A1 | * | 8/2006 | Hughes | 16/430 |

* cited by examiner

*Primary Examiner* — Gene Kim
*Assistant Examiner* — Matthew B Stanczak
(74) *Attorney, Agent, or Firm* — Crossley Patent Law; Mark A. Crossley

(57) ABSTRACT

A simulation play kit is provided for bracing and covering a person's hands and forearms to allow a person to walk on all fours to simulate an animal. The kit includes at least one crutch having a 4 to 6 inch width and having a telescopic extension member adjustable to a maximum a one-foot height. Each crutch has a U-shaped frame member with a brace member across a gap between first and second upper ends and also a hand support bar across the gap below the brace member. The kit also provides at least one faux hand member resembling a human hand with a sleeve attached thereto and may also provide at least one faux foot member which may be either an imaginative human foot or animal foot. The faux foot member also includes a sock portion. The crutch slides through either the faux hand or foot member.

2 Claims, 3 Drawing Sheets

SIMULATION PLAY KIT

BACKGROUND OF THE INVENTION

Various types of adjustable crutches are known in the prior art. However, what is needed is a simulation play kit providing at least one height-adjustable mini-crutch having a hand support bar across a gap therein and faux hand and foot members which fit over the crutches to allow a human to simulate an animal.

FIELD OF THE INVENTION

The present invention relates to toys, and more particularly, to a simulation play kit which provides at least one height-adjustable mini-crutch having a hand support bar across a gap therein and at least one faux hand member and faux foot member which fit over the crutches to allow a human to simulate an animal.

SUMMARY OF THE INVENTION

The general purpose of the present simulation play kit, described subsequently in greater detail, is to provide a simulation play kit which has many novel features that result in a simulation play kit which is not anticipated, rendered obvious, suggested, or even implied by prior art, either alone or in combination thereof.

To accomplish this, the present simulation play kit is designed for bracing and covering a person's hands and forearms to allow a person to walk on all fours to simulate an animal. The kit includes at least one crutch having a 4 to 6 inch width and having a telescopic extension member adjustable to a maximum a one-foot height. Each crutch has a U-shaped frame member with a brace member across a gap between first and second upper ends and also a hand support bar across the gap below the brace member. The kit also provides at least one faux hand member resembling a human hand with a sleeve attached thereto and may also provide at least one faux foot member which may be either an imaginative human foot or animal foot. The faux foot member also includes a sock portion. The crutch slides through either the faux hand or foot member.

The instant simulation play kit may also be used to provide a user with exercise. Each crutch may be made from lightweight and durable materials, which may include heavy duty plastic, aluminum, and similar materials, which will accomplish the task of the present kit. Each faux hand and foot member may be also formed of a combination of lightweight and durable materials, as is each crutch, as well as faux fur material, cotton, or other fabric for the sleeve portion.

Thus has been broadly outlined the more important features of the present simulation play kit so that the detailed description thereof that follows may be better understood and in order that the present contribution to the art may be better appreciated.

Numerous objects, features and advantages of the present simulation play kit will be readily apparent to those of ordinary skill in the art upon reading the following detailed description of presently preferred, but nonetheless illustrative, examples of the present simulation play kit when taken in conjunction with the accompanying drawings. In this respect, before explaining the current examples of the present simulation play kit in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the simulation play kit. It is therefore important that the claims be regarded as including such equivalent constructions insofar as they do not depart from the spirit and scope of the present invention.

Objects of the present simulation play kit, along with various novel features that characterize the invention are particularly pointed out in the claims forming a part of this disclosure. For better understanding of the simulation play kit, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
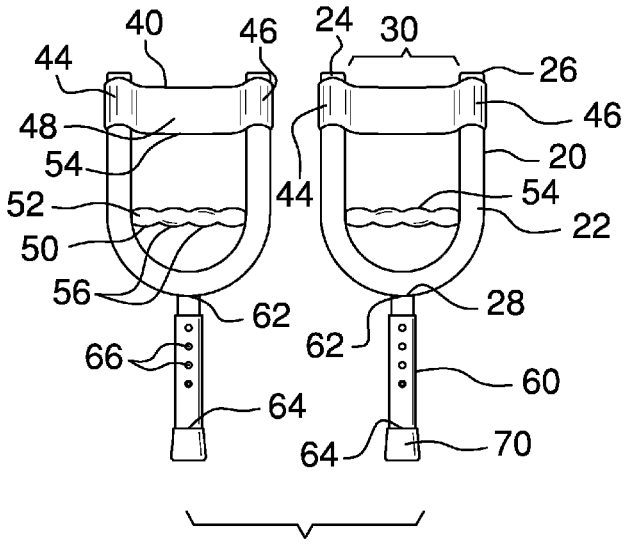
FIG. 1 is a front elevation view of toy crutch.
Figure 2:
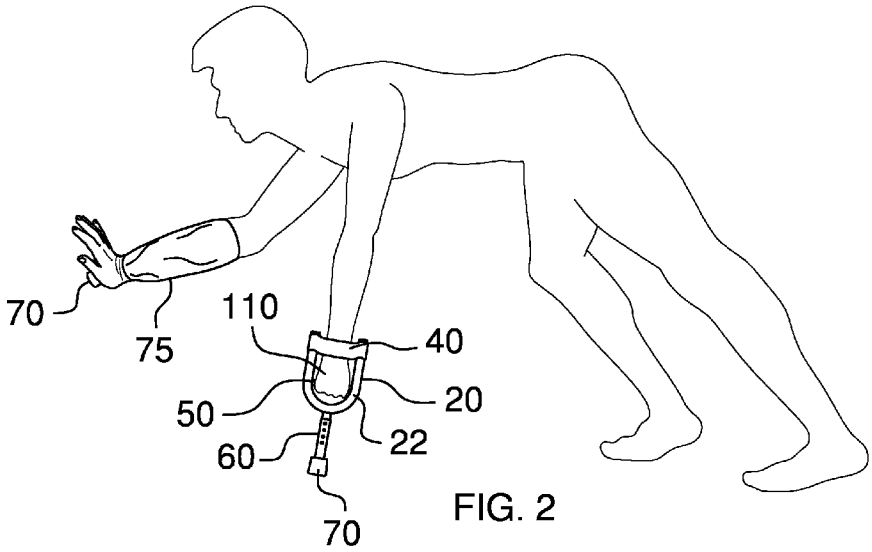
FIG. 2 is an in-side side elevational view illustrating use of a toy crutch by a human to walk using his hands and feet.
Figure 3:
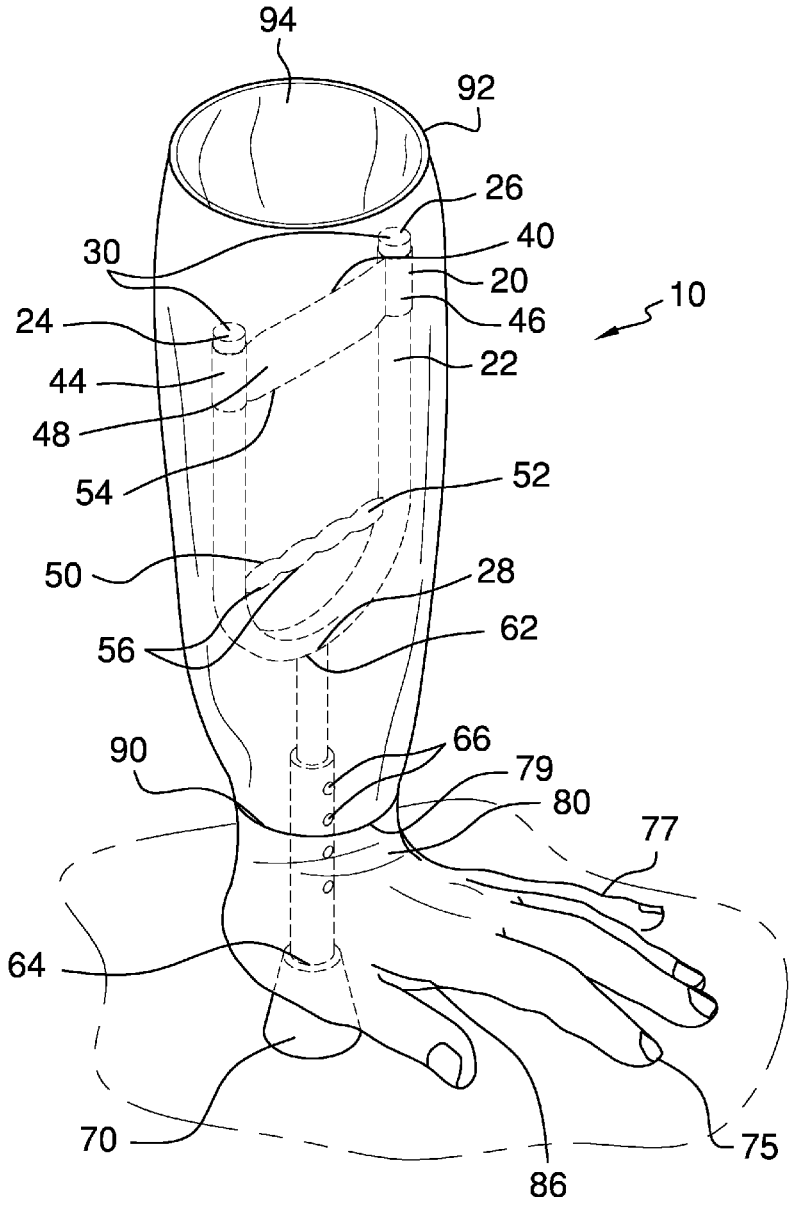
FIG. 3 is an isometric view of faux left hand member having a crutch disposed therein.
Figure 4:
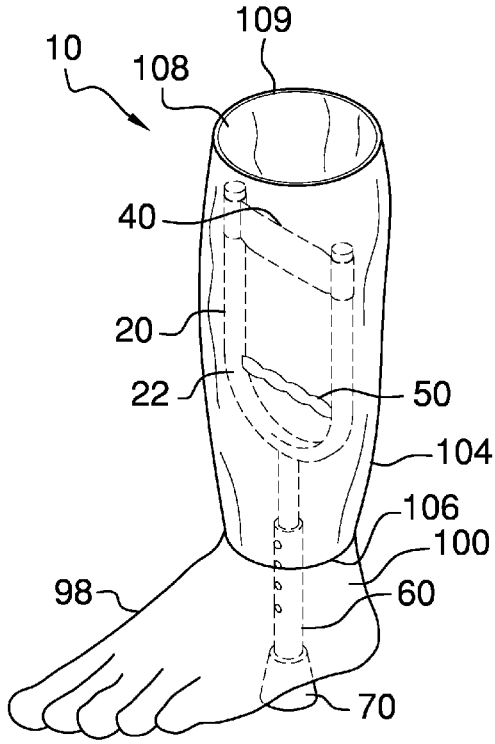
FIG. 4 is an isometric view of a faux right foot member resembling a human foot and having a crutch disposed therein.
Figure 5:
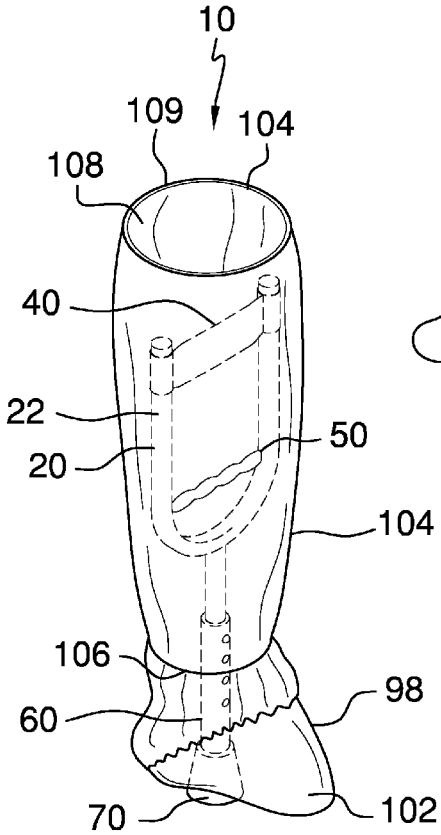
FIG. 5 is an isometric view of faux right foot member resembling an animal foot and having a crutch disposed therein.

With reference now to the drawings, and in particular FIGS. 1 through 5 thereof, example of the instant simulation play kit employing the principles and concepts of the present simulation play kit and generally designated by the reference number 10 will be described.

Referring to FIGS. 1 through 5, the simulation play kit 10 is provided for bracing and covering a person's hands and forearms to simulate an animal. The kit 10 includes at least one crutch 20. Each crutch 20 is adjustable to a maximum height of one foot and has a width in a range of 4 inches to 6 inches. The height and width of each crutch 20 are important to the kit 10 in that the crutch 20 is designed to provide a brace for human hand 110, which may be a child's or an adult's hand, so that the user can walk on all fours to simulate an animal.

Each crutch 20 encompasses a U-shaped frame member 22. The frame member 22 has a first upper end 24, an opposite second upper end 26, and a lower apex 28 disposed midway between the first upper end 24 and the second upper end 26. There is a gap 30 between the first upper end 24 and the second upper end 26.

A brace member 40 spans the gap 30. The brace member 40 includes a concave first portion 44 attached to the first upper end 24 and a concave second portion 46 attached to the second upper end 26. The second portion 46 is identical to the first portion 44. A flat midportion 48 is disposed between the first portion 44 and the second portion 46.

A generally cylindrical hand support bar 50 having an outer wall 52 spans the gap 30 and is disposed about one-third of the distance between the apex 28 and an inside edge 54 of the brace member 40. A plurality of ridges 56 are continuously disposed along the hand support bar 50 outer wall 52.

A cylindrical telescopic extension member 60 extends outwardly from the apex 28. The extension member 60 has an upper edge 62 and a lower edge 64. The extension member 60 also includes a locking mechanism 66. A trapezoidal floor grip 70 is attached to the extension member 60 lower edge 64.

The kit 10 also provides at least one faux hand member 75. Each faux hand member includes a hollow first body 77 that resembles a human hand. The first body 77 has an attachment portion 79 disposed on an upper end 80 of the first body 77. the first body 77 has a palm portion 86. A hollow sleeve 88 has a lower periphery 90 and an upper periphery 92. The lower periphery 90 is attached to the attachment portion 79. A cavity 94 is continuously disposed within the upper periphery 92 of the sleeve 88. Each crutch 20 is removably disposed along a central vertical axis within each hand member 75. The sleeve 88 has a length in a range of 6 to 9 inches in order to substantially cover a user's forearm to better simulate an animal than without such coverage.

The kit 10 may also include at least one sock-attachable faux foot member 96 that includes a hollow second body 98 that may resemble an imaginative human foot 100 or an imaginative animal foot 102. A hollow sock portion 104 continuously attaches to along a top edge 106 of the second body 104. A continuous opening 108 is disposed within a distal edge 109 of the sock portion 104. The faux hand members 75 and the faux foot members 96 interchangeably contain one of the crutches 20 along a central vertical axis of the hand member 75 and foot member 96, respectively. The frame member 22 is selectively vertically disposed within at least one of the sleeve 88 and the sock portion 104.

Use:

To utilize the present kit 10, a user begins by selectively adjusting a height of at least one of the crutches 20. Adjustment of the crutch 20 height is followed by selectively sliding the grip 70 downwardly through the cavity 94, the sleeve 88, and through the palm portion 86 of at least one of the faux hand members 75 and slipping the sleeve 88 over the extension member 60 and the first body 77. The user continues by selectively sliding at least one of a user's human hand 110 through the sleeve 88 of one of the faux hand members 75. After the crutch 20 is in place within the first body 77, the user grips the hand support bar 50. Then, the user may use the crutches 20 to walk on all fours to simulate an animal. The user may alternatively utilize at least one sock-attachable faux foot member 96 to simulate an animal by walking on all fours by selectively sliding at least one of the user's human hands 110 through one of the faux foot members 96 and then selectively sliding the grip 70 downwardly through the opening 108, through the sock portion 104, and through and out of the second body 98.

With respect to the above description then, it is to be realized that the optimum dimensional relationships for the parts of the present simulation play kit to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A method of utilizing a simulation play kit for bracing and covering a person's hands and forearms to simulate an animal, wherein the method comprises:

utilizing a kit comprising:

at least one crutch, each crutch comprising:

a U-shaped frame member having a first upper end, an opposite second upper end, and a lower apex disposed midway between the first upper end and the second upper end;

a gap between the first upper end and the second upper end;

a brace member spanning the gap, the brace member comprising:

a concave first portion attached to the first upper end;

a concave second portion identical to the first portion, the second portion attached to the second upper end;

a flat midportion disposed between the first portion and the second portion;

a generally cylindrical hand support bar having an outer wall, the hand support bar spanning the gap and disposed about one-third of the distance between the apex and an inside edge of the brace member;

a first plurality of ridges continuously disposed along the hand support bar outer wall;

a telescopic extension member extending outwardly from the apex, the extension member having an upper edge and a lower edge;

a trapezoidal grip attached to the extension member lower edge;

at least one sleeve-attachable faux hand member comprising:

a hollow first body that resembles a hand, the first body having an attachment portion disposed on an upper end of the first body;

a hollow sleeve having a lower periphery and an upper periphery, the lower periphery attached to the attachment portion;

a cavity continuously disposed within the upper periphery of the sleeve;

selectively adjusting a height of at least one of the crutches;

selectively sliding the grip downwardly through the cavity, the sleeve, and through the palm portion of at least one of the faux hand members and slipping the sleeve over the extension member and the first body;

selectively sliding at least one of a user's human hand through the sleeve of one of the faux hand members; and gripping the hand support bar.

2. The method of claim 1 further comprising:

selectively utilizing at least one sock-attachable faux foot member comprising:

a hollow second body that resembles a foot;

a hollow sock portion continuously attached to a top edge of the second body;

a continuous opening disposed within a distal edge of the sock portion;

selectively sliding at least one of the user's human hands through one of the faux foot members; and selectively sliding the grip downwardly through the opening, the sock portion, and through the second body.

* * * * *